US005522158A

United States Patent [19]

Swanson

[11] Patent Number: 5,522,158

[45] Date of Patent: Jun. 4, 1996

[54] DRYER DRUM COATER HAVING RECIRCULATION CHAMBER FOR VOC/NOX REDUCTION

[75] Inventor: Malcolm L. Swanson, Chickamauga, Ga.

[73] Assignee: Astec Industries, Inc., Chattanooga, Tenn.

[21] Appl. No.: 207,410

[22] Filed: Mar. 7, 1994

[51] Int. Cl.[6] ..... F26B 3/00

[52] U.S. Cl. ..... 34/479; 34/131; 34/141; 432/106; 366/25

[58] Field of Search ..... 34/72, 79, 86, 34/35, 478, 479, 131, 132, 140, 141; 110/226, 204; 366/25, 137, 2, 4, 7, 12, 159; 432/106; 431/115, 116

[56] References Cited

U.S. PATENT DOCUMENTS

| | | | |
|---|---|---|---|
| 3,741,166 | 6/1973 | Bailey | 431/116 |
| 3,787,562 | 1/1974 | Heller et al. . | |
| 4,600,379 | 7/1986 | Elliott . | |
| 4,725,223 | 2/1988 | Coppin et al. | 431/115 |
| 4,867,572 | 9/1989 | Brock et al. . | |
| 4,892,411 | 1/1990 | Elliott et al. | 366/25 |
| 5,054,931 | 10/1991 | Farnham et al. | 366/25 |
| 5,203,693 | 4/1993 | Swanson . | |
| 5,261,738 | 11/1993 | Brock . | |
| 5,388,985 | 2/1995 | Musil et al. | 431/116 |

*Primary Examiner*—Denise L. Gromada
*Assistant Examiner*—Sara Sachie Raab
*Attorney, Agent, or Firm*—Nilles & Nilles

[57] ABSTRACT

A dryer drum coater has an internal recirculation cylinder for promoting the recirculation of combustion products so as to entrain and incinerate blue smoke formed when heated and dried virgin aggregate is mixed with other asphaltic products such as RAP and/or liquid asphalt in the dryer drum coater. The recirculation cylinder acts to extend and strengthen natural eddy currents formed during operation of the coater such that combustion product recirculation which would normally extend only in the end area of the flame extends far enough toward the base of the flame to entrain the blue smoke and to draw the blue smoke into the base area of the flame. The cylinder may comprise a refractory lined stainless steel shell or may be formed from tee flights of the type used in the combustion zones of dryer drum coaters.

16 Claims, 5 Drawing Sheets

DRYER DRUM COATER HAVING RECIRCULATION CHAMBER FOR VOC/NOX REDUCTION

BACKGROUND OF THE INVENTION

1. Field of the Invention

The invention relates to dryer drum coaters and, more particularly, relates to a method and apparatus for recirculating blue smoke, formed upon the mixing of recycled asphalt products (RAP) with virgin aggregate, into the dryer drum burner flame for incineration.

2. Discussion of the Related Art

The mixing of recycled asphalt products (RAP) with virgin aggregate is now in wide use in the asphalt production industry. The virgin aggregate is typically first heated and dried in a rotary drum of a drum mixer or dryer drum coater and then mixed with RAP and liquid asphalt in a separate mixing chamber of the dryer drum coater to form a hot asphalt mix suitable for paving. One such dryer drum coater, manufactured by Astec Industries, Inc. and commonly known as a "double barrel dryer", is schematically illustrated in FIG. 1. The dryer drum coater 10 illustrated in FIG. 1 comprises an inner drum 12 and a fixed outer sleeve 14 mounted on a common frame 16 in an inclined manner. The inner drum 12 is rotatably mounted on the frame 16 by a plurality of bearings 18 and is driven to rotate by a suitable motor 20. A burner 22 directs a flame 24 generally axially into the interior of inner drum 12.

Inner drum 12 has at its first (upper) end 26 a virgin aggregate inlet 28 and a combustion products outlet 30, and has at its second (lower) end 32 a plurality of openings 34 forming heated and dried virgin aggregate outlets. Inner drum 12 also supports a plurality of paddles 36 extending into a mixing chamber 38 formed between the inner drum 12 and the outer sleeve 14. The interior of the inner drum 12 is functionally separated into a combustion zone located in the vicinity of the burner flame 24 and a drying zone located between the combustion zone and the first end 26 of the drum 12.

Outer sleeve 14 is separated from the inner drum 12 by a sufficient distance to form a mixing chamber 38 which is sufficiently wide to provide clearance for the paddles 36. Outer sleeve 14 has an upper RAP inlet 40, a virgin aggregate inlet 42 cooperating with the openings 34 of the inner drum 12, and an asphalt mix outlet 44. Outer sleeve 14 also receives suitable equipment (not shown) for injecting liquid asphalt into the mixing chamber 38.

In use, virgin aggregate is fed into the virgin aggregate inlet 28 of the inner drum 12 via a suitable conveyor 46 and is heated and dried as it travels downwardly through the inclined drum 12 counter to the direction of the flame 24 from the burner 22. Heated and dried aggregate in the second end 32 of the drum 12 falls through openings 34 in the drum 12, through the inlet 42 in the sleeve 14, and into the mixing chamber 38. RAP is simultaneously fed into mixing chamber 38 from the sleeve inlet 40 by a suitable conveyor 48 and is mixed by the paddles 36 with the heated and dried virgin aggregate. Liquid asphalt is also normally injected at this time, thereby forming an asphalt paving mix. In addition to mixing the virgin aggregate, RAP, and liquid asphalt, the paddles 36 also convey the resulting mix to the mixing chamber outlet 44, where the mix is discharged from the dryer drum coater 10. Combustion products formed during operation of the dryer drum coater 10 rise out of the inner drum 12 through outlet 30 and are conveyed to a downstream device such as a bag house.

Vapors laden with hydrocarbons and other contaminates are typically produced in the mixing chamber 38 upon the mixing of RAP and liquid asphalt with virgin aggregate. These vapors, commonly called and henceforth referred to as "blue smoke", are drawn through the openings 34 and into the interior of inner drum 12. Much of the blue smoke in the drum 12 flows along the shell of the inner drum 12 as represented by the arrows 52 and is discharged from the drum through outlet 30 without ever contacting the burner flame 24, thereby resulting in the emissions of relatively high quantities of undesired pollutants such as VOC's, NOx, etc.

During normal operation of the dryer drum coater 10, the momentum of the burner flame 24 results in a higher pressure region near the end of the flame 24 relative to a lower pressure region near the base of the flame. This pressure differential results in the formation of eddy currents 50 resulting in backward circulation of some of the combustion products. Eddy currents 50 may entrain a small portion of the blue smoke drawn out from the mixing chamber and brought into contact with the flame. However, these eddy currents are too small, too weak, and are located too near the end of the flame to result in significant blue smoke entrainment or significant reduction of blue smoke emissions.

OBJECTS AND SUMMARY OF THE INVENTION

It is therefore an object of the invention to reduce the emissions of blue smoke from a dryer drum coater.

This object is preferably achieved by taking advantage of natural eddy currents formed during operation of the dryer drum coater to direct blue smoke into the burner flame. The method comprises lengthening natural eddy currents formed near an axial end portion of a burner flame in a dryer drum to recirculate combustion products toward a base of the flame such that the combustion products entrain blue smoke and draw the blue smoke into the flame.

More specifically, the method preferably comprises providing a dryer drum, directing a flame generally axially into the drum, and recirculating combustion products from a location near an outer axial end of the flame toward a base of the flame. Further steps include feeding virgin aggregate through the drum such that the aggregate material is heated by the flame, mixing the virgin aggregate with other aspbaltic products such as recycled aggregate product (RAP) or liquid asphalt, thereby producing blue smoke, and entraining the blue smoke with the combustion products during the recirculation step, thereby incinerating the blue smoke.

The method is preferably performed in a "double barrel" dryer drum coater, in which case the mixing step comprises mixing the RAP and the virgin aggregate in a mixing chamber surrounding the drum.

Another object of the invention is to provide a dryer drum coater exhibiting reduced blue smoke emissions.

In accordance with another aspect of the invention, this object is achieved by providing a dryer drum coater comprising a rotary drum which has first and second axial ends and which heats and dries virgin aggregate, a burner directing a flame generally axially into the drum from the second end, means for defining a mixing chamber for mixing heated and virgin aggregate with other asphaltic products, thereby producing blue smoke, and a recirculation cylinder which is located in the drum and which recirculates combustion products from a location axially between the first and second ends towards the second end such that at least a portion of the blue smoke is entrained by recirculating combustion products and incinerated.

The cylinder may be a refractory lined stainless steel cylinder, in which case support links should be provided which mount the cylinder in the drum so as to permit limited movement therebetween.

Alternatively, the cylinder may comprise a plurality of spaced tee flights, in which case angled plates may be provided to substantially bridge gaps formed between adjacent tee flights, thereby providing a segmented cylinder which permits expansion of the flights while providing a functional conduit for the recirculation of combustion products.

Preferably, the drum has a virgin aggregate inlet located near the first end thereof and a virgin aggregate outlet located near the second end thereof. The means for defining in this instance should comprise a device which surrounds at least a portion of the drum to define a chamber for mixing virgin aggregate with RAP. The dryer drum coater preferably comprises a double barrel dryer, in which case the means for defining comprises a fixed sleeve surrounding the rotary drum.

Other objects, features, and advantages of the present invention will become apparent to those skilled in the art in the following detailed description and the accompanying drawings. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a dryer drum coater is provided having an internal recirculation cylinder for promoting the recirculation of combustion products so as to entrain and incinerate blue smoke formed when heated and dried virgin aggregate is mixed with other asphaltic products such as RAP and/or liquid asphalt in the dryer drum coater. The recirculation cylinder acts to extend and strengthen natural eddy currents formed during operation of the coater such that combustion product recirculation which would normally extend only in the end area of the flame extends far enough toward the base of the flame to entrain the blue smoke and to draw the blue smoke into the base area of the flame. The cylinder may comprise a refractory lined stainless steel shell or may be formed from tee flights of the type commonly used in the combustion zones of dryer drum coaters.

2. System Overview and Construction and Operation of the First Embodiment

Figure 1:
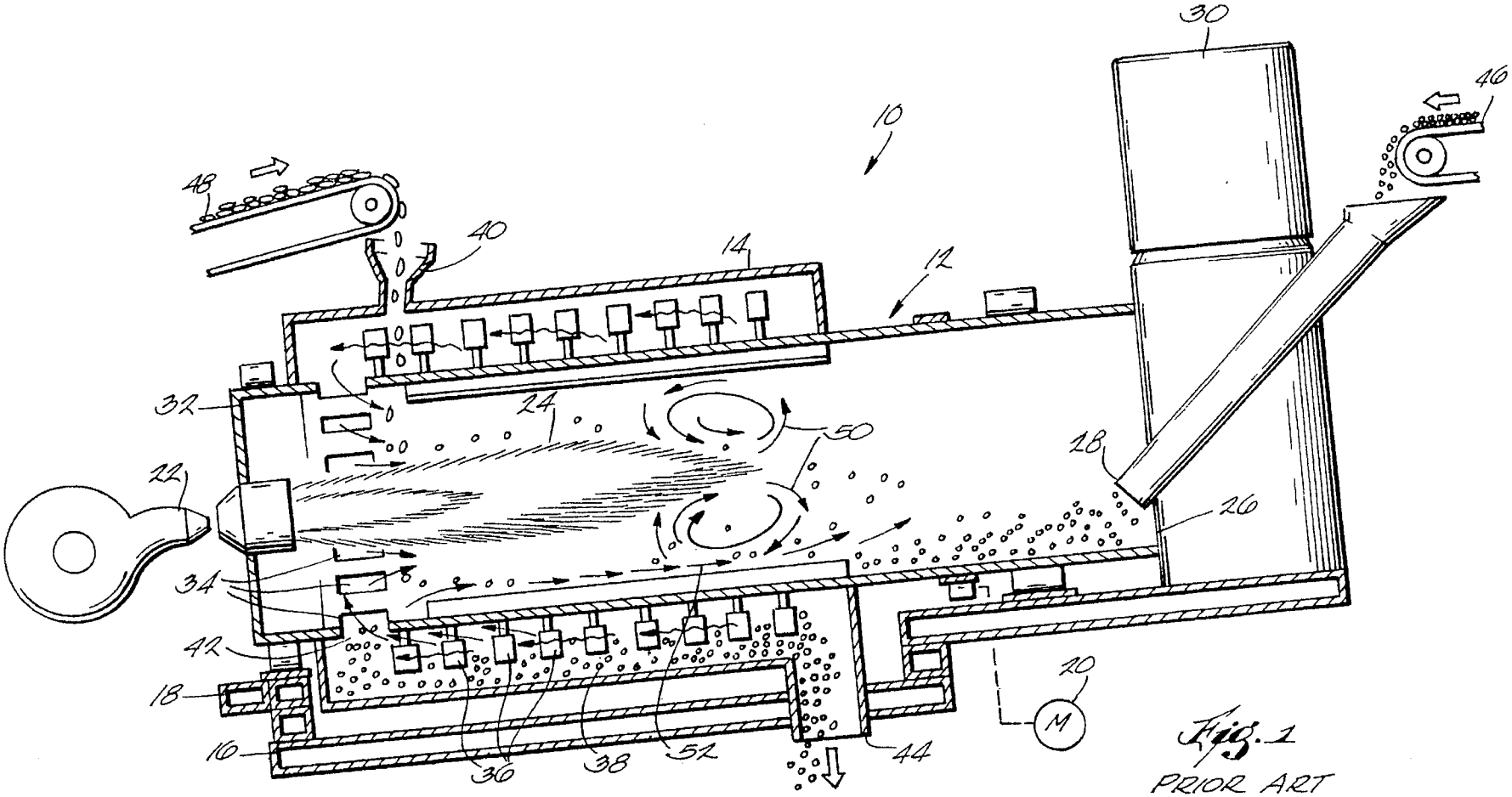
Fig. 1 PRIOR ART
FIG. 1 is a sectional side elevation view of a prior art dryer drum coater, appropriately labeled "PRIOR ART"
Figure 2:
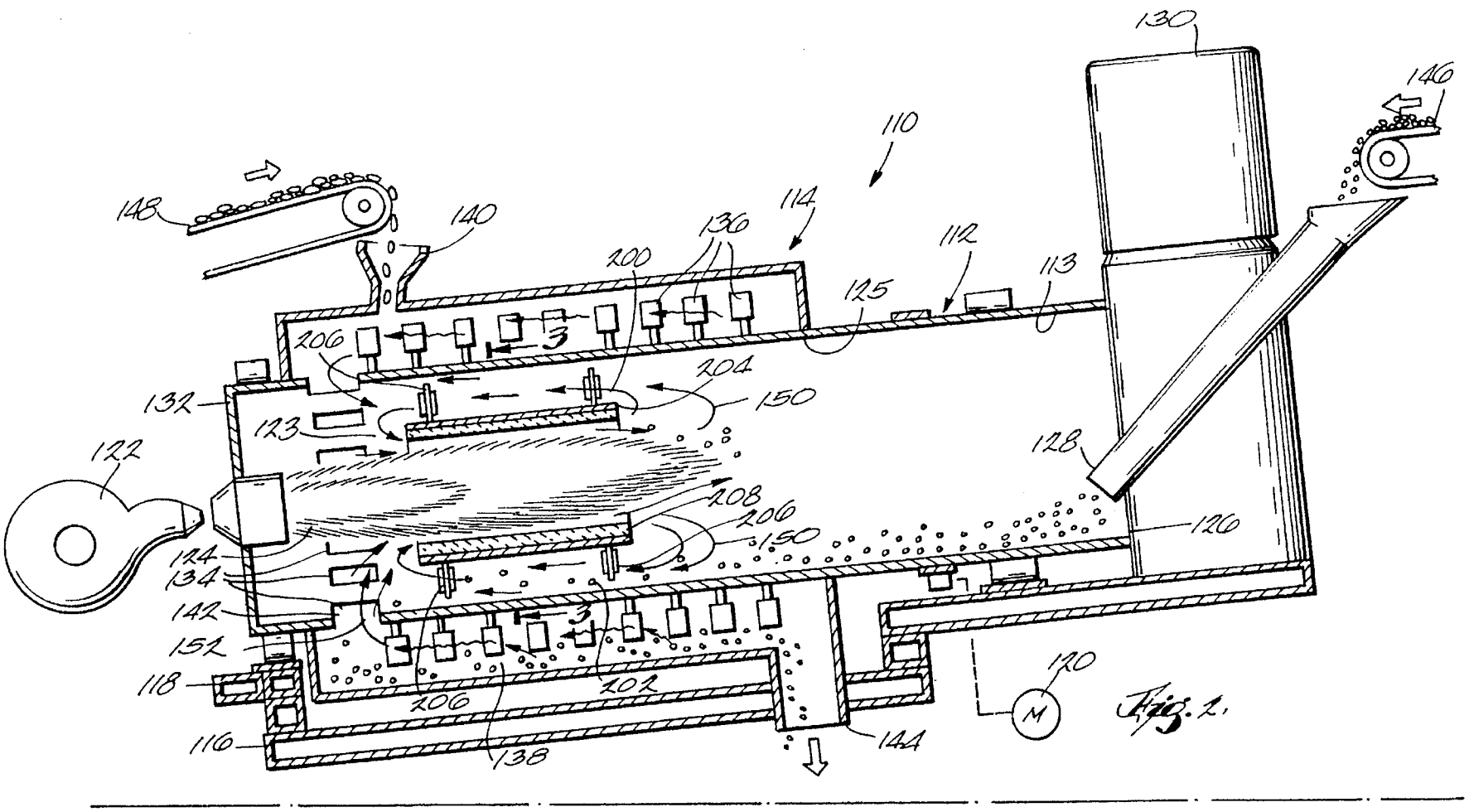
FIG. 2 is a sectional side elevation view of a dryer drum coater constructed in accordance with a first embodiment of the present invention.
Figure 3:
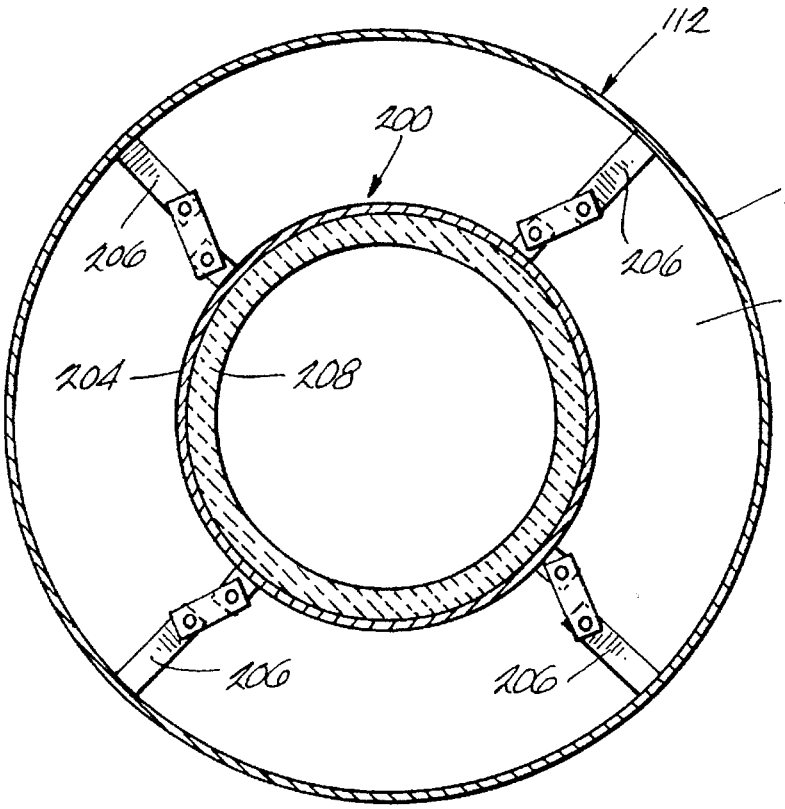
FIG. 3 is a sectional end view taken along the lines 3—3 in FIG. 2.
Figure 4:
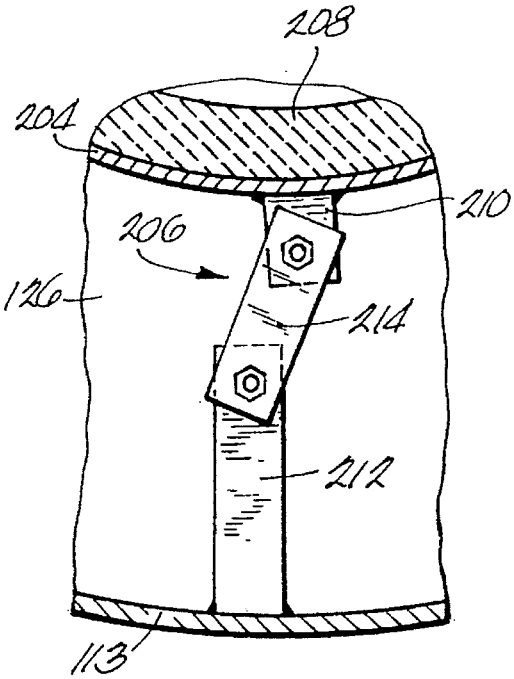
FIG. 4 is a front view of a support link and of the adjacent portions of the dryer drum shell and cylinder illustrated in FIG. 3.
Figure 5:
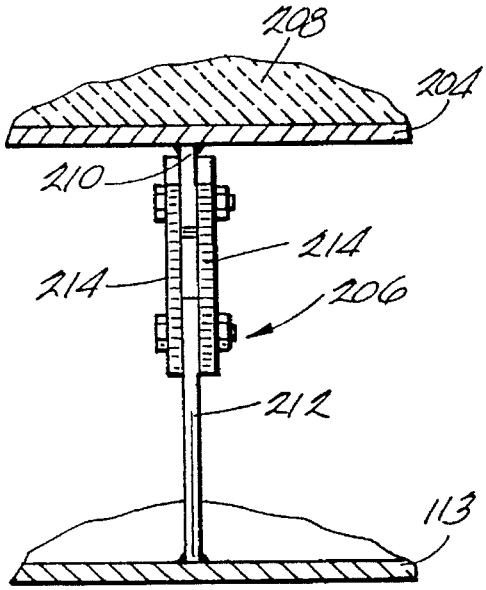
FIG. 5 is a side view of the support link and of the adjacent portions of the dryer drum shell and cylinder of FIG. 3.
Figure 6:
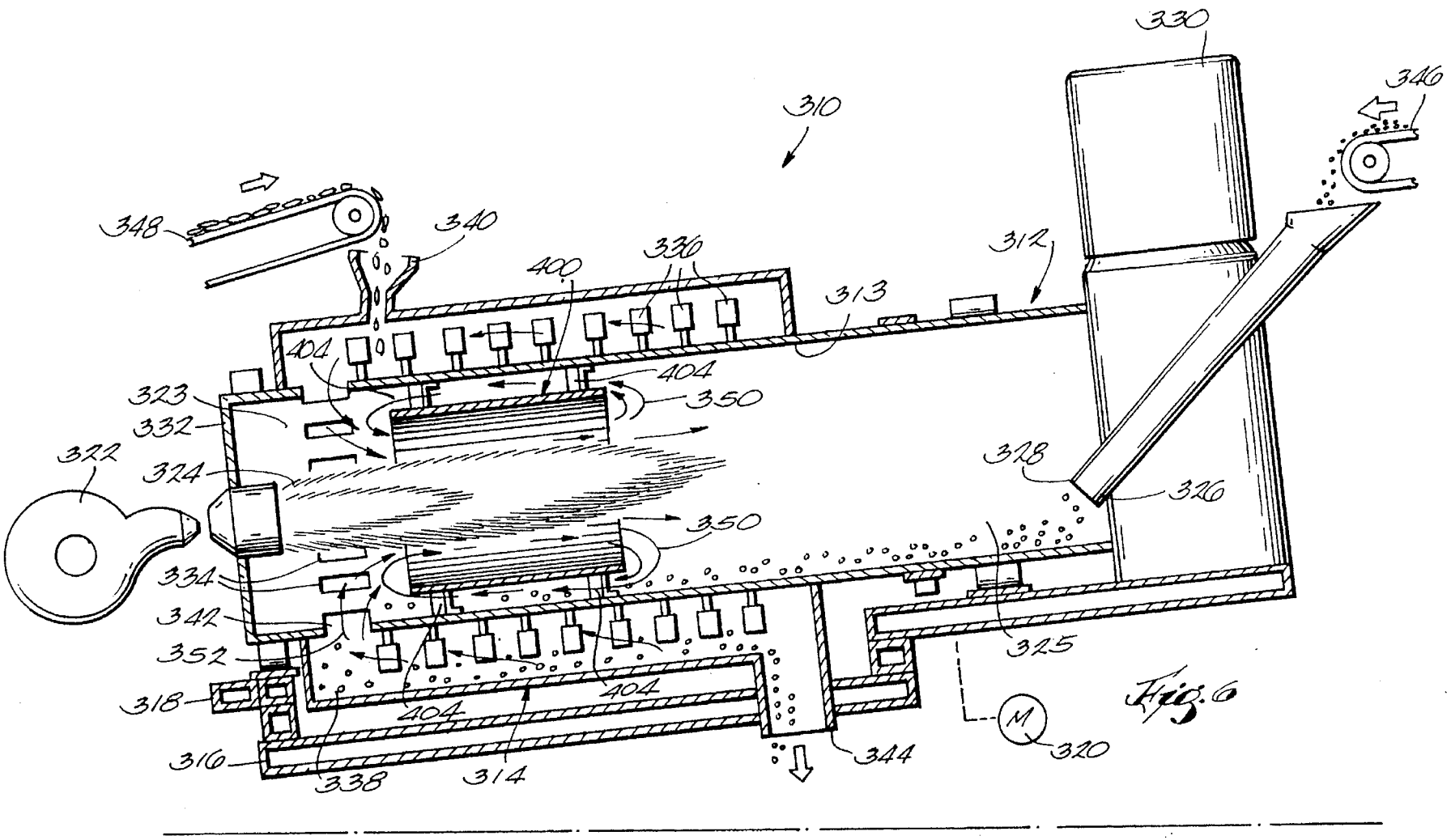
FIG. 6 is a sectional side elevation view of a dryer drum coater constructed in accordance with a second embodiment of the invention.

Referring now to FIGS. 2–5 and to FIG. 2 in particular, a drum mixer or dryer drum coater 110 is illustrated which, except for incorporating a recirculation cylinder 200, is identical in construction to the dryer drum coater 10 of FIG. 1 and, accordingly, is denoted by the same reference numerals, incremented by 100. Dryer drum coater 110 thus includes an inner drum 112 and a fixed outer sleeve 114 mounted on a common frame 116 in an inclined manner. The inner drum 112 is rotatably mounted on the frame 116 by a plurality of bearings 118 and is driven to rotate by a suitable motor 120. A burner 122 directs a flame 124 generally axially into the interior of drum 112.

Inner drum 112 comprises a cylindrical shell 113 having at its first (upper) end 126 a virgin aggregate inlet 128 and a combustion products outlet 130, and having at its second (lower) end 132 a plurality of openings 134 forming heated and dried aggregate outlets. Inner drum 112 also supports a plurality of paddles 136 extending into a mixing chamber 138 formed between the inner drum 112 and the outer sleeve 114. The interior of the inner drum 112 is functionally separated into a combustion zone 123 located in the vicinity of the burner flame 124 and a drying zone 125 located between the combustion zone 123 and the first end 126 of the inner drum 112.

Outer sleeve 114 is separated from the inner drum 112 by a sufficient distance to define a mixing chamber 138 which is sufficiently wide to provide clearance for the paddles 136. Outer sleeve 114 has an upper RAP inlet 140, a virgin aggregate inlet 142 cooperating with the openings 134 of the inner drum 112, and an asphalt mix outlet 144. Outer sleeve 114 also receives suitable equipment (not shown) for injecting liquid asphalt into the mixing chamber 138.

Recirculation cylinder 200 may comprise any structure adapted to lengthen and strengthen the natural eddy currents formed at the end of the burner flame 124 so as to entrain blue smoke flowing into the drum 112 from the mixing chamber 138 and so as to draw the blue smoke into the base area of the flame 124 for incineration. The cylinder 200 should be sufficiently long so that its front end is located in the area of the boundary between the higher and lower pressure zones in which the natural eddy currents are formed, and the rear end should be located sufficiently close to the inlet 142 of the outer sleeve 114 to assure entrainment of at least a significant portion of the blue smoke. Cylinder 200 should also be spaced from the shell 113 of the inner drum 112 by a sufficient distance to permit the unobstructed passage of aggregate and combustion products through a recirculation chamber 202 defined between the outer surface of the cylinder 200 and the inner drum shell 113. Thus, if the cylinder 200 is to be used in a rotating drum 112 having a diameter of 8 feet, the cylinder 200 should have an outer diameter of about 6 feet and a length of at least 6 feet.

Cylinder 200 illustrated in FIGS. 2–5 comprises a metal shell 204 mounted in the drum by a plurality of metal support links 206 and lined on its inner radial periphery with a refractory liner 208. The shell 204 should be about ⅜" thick and should be formed from relatively strong yet heat resistant material such as stainless steel. The refractory liner 208 should be about 4½" thick and may be formed from any suitable refractory material such as a cast metal or a phosphate bonded plastic. The support links 206 are preferably arranged to permit limited movement of the cylinder 200 with respect to the inner drum 112 for thermal expansion purposes and thus each include with reference to FIGS. 3–5 a first bracket 210 fixed to the metal shell 204 of the cylinder 200, a second bracket 212 fixed to the shell 113 of the drum 112, and a pair of links 214 each of which is pivotally connected to both of the brackets 210 and 212.

In use, virgin aggregate is fed into the virgin aggregate inlet 128 of the inclined inner rotary drum 112 via a suitable conveyor 146 and is heated and dried by heat from the burner flame 124 as it is conveyed downwardly through the drum 112 counter to the direction of the flame 124. The heated and dried aggregate empties into the outer mixing chamber 138 through the outlets 134 of the drum 112 and the inlet 142 of the sleeve 114. RAP is also fed into mixing chamber 138 via a conveyor 148 and RAP inlet 140 and is then mixed with the heated and dried virgin aggregate by the paddles 136. Liquid asphalt is also added to the virgin aggregate/RAP mixture to produce an asphalt mix. The asphalt mix is conveyed by the paddles 136 to the outlet 144 and discharged from the dryer drum coater 110. Combustion products formed during operation of the dryer drum coater 110 are discharged from outlet 130 and are conveyed to a bag house or the like for further treatment.

Blue smoke, formed in the mixing chamber 138 when RAP and liquid asphalt are mixed with heated and dried virgin aggregate, is drawn into the inner drum 112 through the openings 134. Much of this blue smoke would normally flow along the shell 113 of the inner drum 112 and out of the vapor outlet 130 but, due to the presence of the cylinder 200, is entrained by eddy currents 150 and incinerated. Specifically, eddy currents 150, formed from combustion products in the drum 112 and resulting from the pressure differential between the end and base of the burner flame 124, are extended due to the presence of recirculation cylinder 200 and flow around the cylinder 200 so as to entrain the blue smoke in the vicinity of openings 134 and draw the blue smoke into the burner flame 124 for incineration as represented by the arrows 152 in FIG. 2. In practice, about 15% of the combustion products are recirculated around the cylinder 200. The entrainment and subsequent incineration of blue smoke not only reduces hydrocarbon emissions but also leads to an associated reduction of free oxygen, resulting in reduced NOx formation.

While the recirculation cylinder 200 and associated chamber 202 have been described in conjunction with a "double barrel" counterflow type dryer drum coater or drum mixer, it should be understood that such a cylinder could be used in virtually any dryer drum coater or drum mixer in which heated and dried virgin aggregate is mixed with RAP or any other materials which may result in blue smoke emissions. The cylinder 200 also need not take the form illustrated but could instead be formed from a variety of different structures. One such alternative structure will now be described.

3. Description and Operation of Second Embodiment

Referring now to FIGS. 6–9, a dryer drum coater 310 or drum mixer is illustrated which is identical to that illustrated in FIGS. 2–5 except for the fact that it employs a different recirculation cylinder 400. Elements of the dryer drum coater 310 of FIGS. 6–9 corresponding to those of the dryer drum coater 110 of FIGS. 2–5 (excluding the recirculation cylinder) are thus denoted by the same reference numerals incremented by 200 and include an inner rotary drum 312 presenting combustion and drying zones 323 and 325, an outer fixed sleeve 314 presenting a mixing chamber 338, and a burner 322 supplying a flame 324 into the interior of drum 312. A more detailed description of dryer drum coater 310 is omitted for conciseness.

Figure 8:
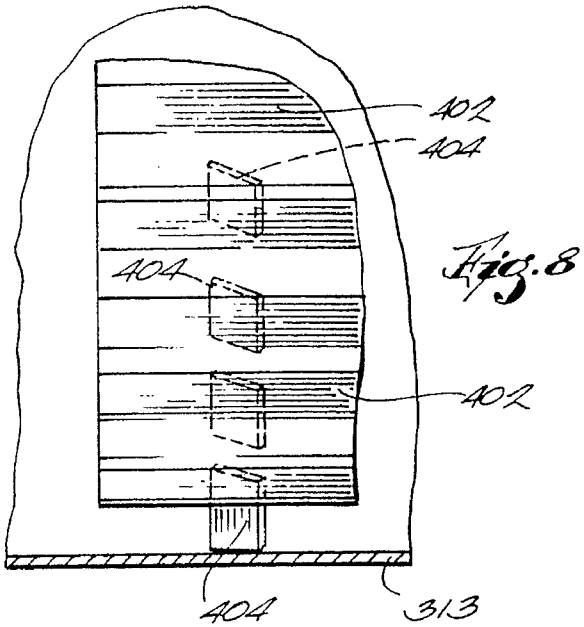
FIG. 8 is a sectional view taken along the lines 8—8 of FIG. 7.
Figure 7:
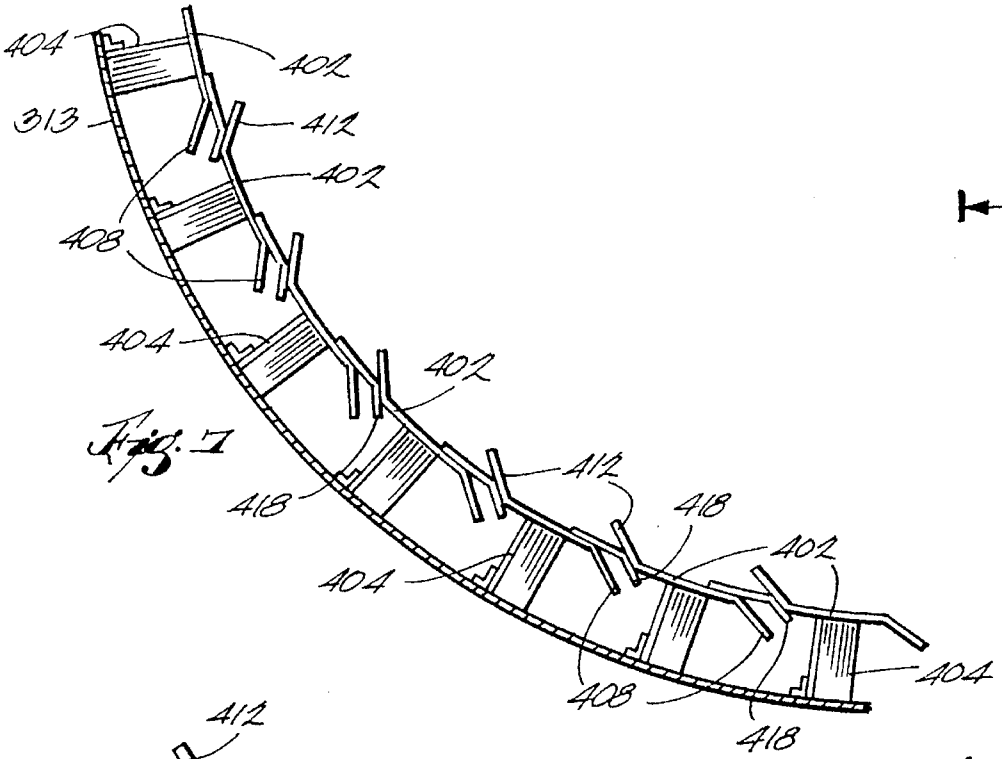
FIG. 7 is a sectional end view of a portion of the inner drum of the dryer drum coater of FIG. 6.
Figure 9:
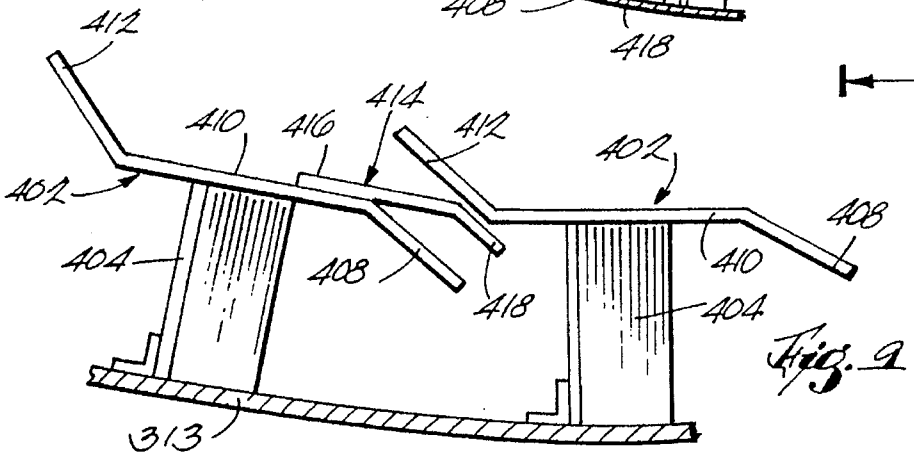
FIG. 9 is an enlarged view of a portion of the structure illustrated in FIG. 7.

Referring to FIGS. 7–9, cylinder 400 differs from that of FIGS. 2–5 in that it is constructed from a plurality of tee flights 402 rather than from a contiguous metal shell. Such tee flights are commonly used in the combustion zone of a dryer drum to shield the drum shell from the burner flame heat while at the same time limiting flow of aggregate directly into the burner flame. The illustrated tee flights 402 are spaced about the entire circumference of the inner surface of the drum shell 313 and are mounted on the shell 313 by means of posts 404 spaced longitudinally along the lengths of the flights 402. Referring especially to FIG. 9, each flight 402 has an outwardly angled leading edge portion 408, a medial portion 410 extending generally parallel to the drum shell 313, and an inwardly angled trailing edge portion 412.

Tee flights 402 differ from conventional flights primarily in that they are connected to the drum shell 413 by significantly longer posts 404 to permit the passage of aggregate and recirculating combustion products between the flights 402 and the drum shell 313. Flights 402 should also be located radially closer together than is conventional in the art so as to present a substantially contiguous, though segmented, cylinder 400. The same affect can be achieved by providing the standard spacing between the tee flights 402 and by attaching to the leading edge 408 of each tee flight 402 an angled bracket 414 having a trailing portion 416 connected to the medial portion 410 of the tee flight 402 and a leading portion 418 extending at an angle from the trailing portion 416 and spaced from the trailing portion 412 of an adjacent flight 402 by a relatively short gap of e.g., ⅛". The resulting segmented construction permits expansion of the flights 402 while providing a functional conduit for the recirculation of combustion products.

Operation of the dryer drum coater 310 of FIGS. 6–9 is essentially identical to that of the coater of FIGS. 2–5. That is, blue smoke, formed when heated and dried virgin aggregate is mixed with RAP and/or liquid asphalt in the mixing chamber 338, is drawn into the dryer drum 312 through the openings 334. The blue smoke is then entrained by the eddy currents 350 of combustion products flowing around the cylinder 400 drawn into the burner flame as represented by the arrows 352. As in the previous embodiment, the entrainment of the blue smoke by the recirculating combustion products results in hydrocarbon incineration as well as reduced VOC formation.

Many changes and modifications could be made to the present invention without departing from the spirit thereof. The scope of such changes will become apparent from a reading of the appended claims.

I claim:

1. A method of reducing the emission of vapors from a dryer drum coater, said method comprising A. providing a dryer drum;

B. directing a flame generally axially into said drum;

C. recirculating combustion products from a location near an outer axial end of said flame toward a base of said flame;

D. feeding virgin aggregate through said drum such that said virgin aggregate is heated and dried by said flame;

E. discharging heated and dried virgin aggregate from an aggregate outlet of said drum and into an aggregate introduction end of a mixing chamber located outside of said dryer drum;

F. mixing said heated and dried virgin aggregate with other asphaltic products in said mixing chamber, thereby producing blue smoke;

G. drawing blue smoke out of said aggregate introduction end of said mixing chamber and into said dryer drum; and H. entraining said blue smoke drawn from said mixing chamber with said combustion products during said recirculation step, thereby incinerating said blue smoke.

2. A method as defined in claim 1, wherein said recirculating step comprises directing said combustion products between a recirculation cylinder and an inner surface of said drum.

3. A method as defined in claim 2, further comprising the step of guiding said combustion products between said cylinder and said flame after said blue smoke is entrained by said combustion products.

4. A method as defined in claim 1, wherein said other asphaltic products comprise at least one of RAP and liquid asphalt.

5. A method comprising:

A. providing a recirculation device which at least partially surrounds a burner flame in a dryer drum and extends at least a substantial length of said burner flame, said recirculation device lengthening natural eddy currents formed near an axial end portion of said burner flame to recirculate combustion products toward a base of said flame such that said combustion products entrain blue smoke, formed when virgin aggregate is mixed with other asphaltic products, and B. drawing said blue smoke into said flame.

6. A method as defined in claim 5, wherein said lengthening step comprises drawing combustion products around and through an annular recirculation cylinder positioned in said drum.

7. A dryer drum coater, comprising:

A. a rotary drum which has first and second axial ends and which heats and dries virgin aggregate;

B. a burner directing a flame generally axially into said drum from said second end;

C. means for defining a mixing chamber for mixing heated and dried virgin aggregate with other asphaltic products, thereby producing blue smoke; and D. a recirculation device which is located in said drum, which at least partially surrounds said burner flame, and which lengthens natural eddy currents formed near an axial end portion of said burner flame thereby recirculating combustion products from said axial end portion of said flame towards said second end such that at least a portion of said blue smoke is entrained by recirculating combustion products and incinerated.

8. A dryer drum coater as defined in claim 7, wherein said recirculation device comprises an annular cylinder located in a combustion zone of said drum.

9. A dryer drum coater as defined in claim 8, wherein said cylinder is mounted in said drum for rotation therewith.

10. A dryer drum coater as defined in claim 8, wherein said cylinder is a refractory lined stainless steel cylinder.

11. A dryer drum coater as defined in claim 10, further comprising support links which mount said cylinder in said drum so as to permit limited movement therebetween.

12. A dryer drum coater as defined in claim 7, wherein said drum has a virgin aggregate inlet located near said first end thereof and a virgin aggregate outlet located near said second end thereof, and wherein said means for defining comprises a device which surrounds at least a portion of said drum to define said mixing chamber.

13. A dryer drum coater as defined in claim 12, wherein said device comprises a fixed sleeve.

14. A dryer drum coater as defined in claim 7, wherein said mixing chamber comprises an aggregate introduction end into which said heated and dried virgin aggregate is introduced after it is discharged from said rotary drum, and wherein said entrained blue smoke is drawn from said aggregate introduction end of said mixing chamber.

15. A dryer drum coater, comprising:

A. a rotary drum which has first and second axial ends and which heats and dries virgin aggregate;

B. a burner directing a flame generally axially into said drum from said second end;

C. means for defining a mixing chamber for mixing heated and dried virgin aggregate with other asphaltic products, thereby producing blue smoke; and D. a recirculation device which is located in said drum and which recirculates combustion products from a location axially between said first and second ends towards said second end such that at least a portion of said blue smoke is entrained by recirculating combustion products and incinerated, said recirculation device comprising an annular cylinder located in a combustion zone of said drum, said cylinder is mounted in said drum for rotation therewith, said cylinder further including a plurality of spaced tee flights.

16. A dryer drum coater as defined in claim 15, wherein said cylinder further comprises angled plates which substantially bridge gaps formed between adjacent tee flights.

* * * * *